United States Patent [19]

Williams

[11] 3,981,454

[45] Sept. 21, 1976

[54] WASTE MATERIAL PROCESSING APPARATUS

[75] Inventor: Robert M. Williams, Ladue, Mo.

[73] Assignee: Williams Patent Crusher and Pulverizer Company, St. Louis, Mo.

[22] Filed: July 7, 1975

[21] Appl. No.: 593,625

[52] U.S. Cl. ..... 241/24; 241/29; 241/78; 241/79.1; 241/189 R; 241/DIG. 38

[51] Int. Cl.[2] ..... B02C 23/10

[58] Field of Search ..... 241/24, 29, 43, 45, 241/58, 60, 62, 76, 78, 79.1, 186 R, 189 R, 189 A, DIG. 38

[56] References Cited

UNITED STATES PATENTS

| | | | |
|---|---|---|---|
| 3,524,594 | 8/1970 | Anderson et al. | 241/DIG. 38 |
| 3,806,048 | 4/1974 | Williams | 241/189 A |
| 3,844,491 | 10/1974 | Williams | 241/24 |
| 3,905,556 | 9/1975 | Drage | 241/DIG. 38 |
| 3,922,975 | 12/1975 | Reese | 241/DIG. 38 |
| 3,925,198 | 12/1975 | Eckhoff et al. | 241/DIG. 38 |

*Primary Examiner*—Granville Y. Custer, Jr.
*Attorney, Agent, or Firm*—Gravely, Lieder & Woodruff

[57] ABSTRACT

Apparatus for processing waste material in which an air column effects separation of the heavy material after first stage shredding and the remainder of the material is subjected to second stage shredding with a system for controlling the second stage so it will operate without plugging and reduce the material to a condition in which a cyclone separator yields a product suitable for a fuel while the air in the apparatus is cleaned before being expelled to atmosphere.

8 Claims, 1 Drawing Figure

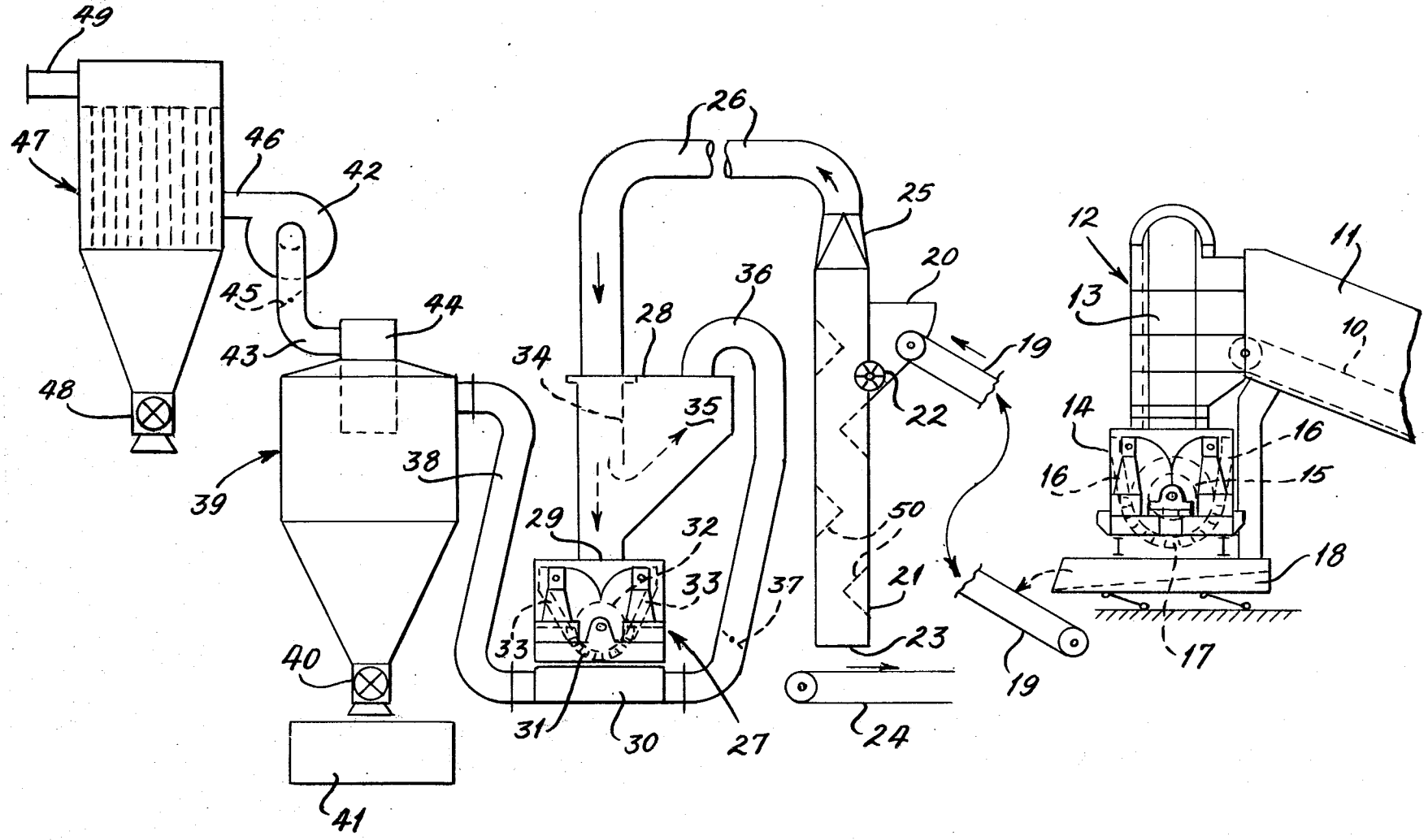
10
11
12
13
14
15
16
16
17
18
19
19
20
21
22
23
24
25
26
27
28
29
30
31
32
33
33
34
35
36
37
38
39
40
41
42
43
44
45
46
47
48
49
50

WASTE MATERIAL PROCESSING APPARATUS

BACKGROUND OF THE DISCLOSURE

The task of disposing of waste material generated by homes, commercial businesses and factories is an ever increasing problem and will go on increasing with population growth and the continued reliance on "throw away" items. The trash that is most difficult to handle is a haphazard mixture of metallics and burnables due to lack of initial efforts to segregate trash by classes of components. Public apathy is partly responsible for creating the waste disposal problem. The problem is also present because of the failure to recognize the potential energy which is present in the waste material for use as a fuel for heat and electricity generation.

The apparatus of this disclosure is particularly adapted to the processing of haphazardly intermingled waste material so that the components having fuel value can be separated out from other classes of material. The apparatus adapted for this purpose is especially simplified so as to increase the effectiveness of disposal of waste material of the character above referred to with functional components which keep the cost within reasonable bounds.

BRIEF DESCRIPTION OF THE APPARATUS

This invention relates to apparatus for processing waste material into portions having fuel values and portions having other values.

A preferred embodiment comprises a first stage shredder which performs the initial task of reducing haphazardly mixed waste material to a stage of fineness which will respond to specific gravity separation in a moving column of air, subjecting the air responsive components to a second stage shredding action in combination with means to prevent stoppage of the second stage shredding action, means to prevent air system stoppage, and means to treat the output of the second stage shredder to cyclonic separation from the air stream, thereby substantially cleaning the air stream before releasing it to atmosphere and separately collecting the material fall out from the air column and the product from the cyclonic separator for further processing.

Components of the preferred apparatus may include the shredding mill disclosed in my prior U.S. Pat. No. 3,844,491 granted Oct. 29, 1974 which performs the initial reduction of the waste material. This prior patent also disclosed a conduit which formed an air stream for the specific gravity separation of the shredded material from the mill. In addition, the present apparatus may include a reversible shredder mill of the character disclosed in my prior U.S. Pat. No. 3,637,145, granted Jan. 25, 1972. The mill of this latter patent functions as the second stage shredder and is supplied with a suitable grate as its discharge. With such prior art components connected up in the manner hereinafter disclosed, there results more efficient, desirable and less expensive apparatus for processing large quantities of waste material quickly and with very little undesirable impact on the environment.

It is known to employ a moving column of air to effect separation of materials on the principal of specific gravity differences in such materials. However, in addition to my prior U.S. Pat. No. 3,844,491, I am aware that this principle has been disclosed in the complicated and complex apparatus of Gillespie et al in U.S. Pat. No. 3,650,396, granted Mar. 21, 1972, but that apparatus is expensive and operates in a much more complicated manner and fails to produce a component which has fuel value.

In the preferred embodiment the unique arrangement of components includes an air and shredded material disengaging hopper and air by-pass around the second stage shredder, which components establish a simple means for insuring the desired operation of the air separation column in the event the second stage shredder should momentarily plug up at the discharge grate due to overloading the hammer rotor. The embodiment is unique in that it eliminates the need for the usual cyclone separator, fan and bag collector connected into the system between the first and second stage shredders.

BRIEF DESCRIPTION OF THE DRAWING

The above referred to apparatus is shown in the single view of the drawing which is a schematic system arrangement conforming to the principles of my invention.

DETAILED DESCRIPTION OF THE APPARATUS

The apparatus above referred to is made up of two stages of material shredding with an intervening stage of air density separation, means connected into the second stage shredder to prevent clogging of this stage, means to prevent air system clogging, as well as centrifugal separation of the shredded material so that air moving in the apparatus can be cleaned of material before being discharged.

More specifically the waste material is placed on the infeed conveyor 10 moving in a protective covering or hood 11 to be dumped through an elevated side opening in the first stage shredder 12. This shredder 12 is constructed with a closed chamber 13 over its inlet to the housing 14 which encloses a hammer rotor 15 revolving between adjustable breaker blocks 16 and adjacent a grate assembly 17. As the waste material is shredded portions are reduced to a size capable of passing through the grate 17 and portions may be hit by the rotor hammers and flung back into the chamber 13 where it is again returned to the shredding action of the hammer rotor. The size capable of passing through grate 17 is that which will pass a screen having 3 inch to 4 inch square openings. Eventually all of the waste material will pass the first stage shredder 12 and fall onto a vibratory conveyor 18 where the material is conveyed onto an elevating belt conveyor 19.

The material is moved to the infeed hopper 20 of a vertically directed air column 21. The hopper has a rotary inlet gate 22 which admits the waste material into the column 21 and restricts the escape of the flow of air. The column has a bottom open end 23 to direct the more dense fractions of the waste material, such as chunks of metal or stones or discarded curtain rod, or generally ferrous and non-ferrous metals, glass, rubber chunks, rocks, and hard to grind waste material that is not responsive to the lifting effect of the air flow, whereby it is bound to fall by gravity and against the upwardly moving column of air onto a belt conveyor 24 to be carried to a collection station (not shown). The flow of air in the column 21 is adjusted as to its velocity, of the order of 1000 to 2000 feet per minute, so that the light weight fractions of waste material will be lifted and floated through the top outlet 25 into a conduit 26 which conducts the material to the second stage shredder 27. This second shredder 27 is provided with a disengaging hopper 28 over its inlet 29 and with an outlet casing 30 below the grate assembly 31 under the hammer rotor 32 and associated breaker blocks 33. The hopper 28 is provided to disengage the air from the product or material being processed by giving the air a sudden turn in its flow into bypass conduit 36, and this turn throws or disengages the material from the air so that the material may continue down into the mill 27.

The special feature of the second stage shredder is the insertion of the disengaging hopper 28 at the inlet to the shredder 27 to prevent clogged this shredder through the possibility of the fines packing together over the inlet 29 and causing the rotor 32 to experience a condition of cavitation where the rotor hammers merely revolve without performing any shredding function. This problem is overcome by providing the hopper 28 with an internal baffle 34 and an enlarged side chamber 35 connected to a by-pass conduit 36 which is connected into the outlet box or casing 30. The conduit 36 is provided with a flow control damper 37 to regulate the flow through the by-pass conduit for the purpose of obtaining a negative pressure across the shredder 27 so that there can be no tendency to clog up the rotor and cause cavitation which is wasteful of energy and detracts from the efficiency of the shredder and apparatus combined with it. In the foregoing combination of apparatus the flow of air caused by the blower 42 enters the air column 21 and is regulated by the dampers 37 and 45 so as to maintain this flow at a substantially constant rate of the order of from 1000 to 2000 feet per minute. Should the second stage shredder 27 momentarily fill with material so as to reduce the air movement through the grate 31, the air will flow through the by-pass conduit 36 and thus maintain the air separation efficiently of the column 21. This arrangement incorporates two air moving paths into one system so as to eliminate what has heretofor been considered necessary where two shredding stages are used in series with an intervening cyclone separator and bag collector.

The output from the second stage shredder 27 at its casing 30 is moved through a conduit 38 into the top of a cyclone separator 39 where in the swirling action the waste material fraction reaching this point is thrown out, collected in the bottom of the cyclone chamber and released through a rotary valve unit 40 to be collected in a bin 41 or similar collector. The material fractions referred to here may consist of paper, cardboard, shredded lawn and shrubbery cuttings, shredded sticks, tree branches, bits of glass and plastic materials and similar waste typically found in collections made by packer trucks from domestic areas of a community, but not limited thereto, as commercial and industrial areas are also served by the packer truck pick-up. The air now freed from most of the shredded material is sucked into the blower 42 through conduit 43 connected in the cupola 44 on the separator 39. Conduit 43 is provided with a control damper 45 which with the damper 37 regulates the air movement in the system.

The blower outlet is connected into a bag type dust collector 47 where the fines and dust fractions are collected and released at the rotary valve 48 while the now substantially dust and fines free air is exhausted at outlet 49 back to the atmosphere.

In apparatus combined in the above system the air density separator column 21 is effective to cause about 30% of the waste material to fall out onto conveyor 24, while about 70% of the material is carried over in conduit 26 to the second stage shredder 27. This ratio of separation in column 21 is reached by manipulating damper 45 at the blower inlet 43 and damper 37 in the by-pass conduit 36. These dampers are adjusted such that the velocity of the air in the column 21 will be of the order of 1000 to 2000 feet per minute which is deemed sufficient to float shredded material of light weight character, such as paper, lawn and shrubbery cuttings, sticks, tree branches, plastic materials and other trash usually collected by packer trucks, through the top 25, and simultaneously to set the flow in the by-pass 36 so the second stage shredder 27 operates under a negative pressure condition so the material will not clog up the inlet and allow the rotor 32 to cavitate. The negative condition is obtained by having the flow in the outlet casing 30 produce a suction effect across the rotor 32 and grate 31 to keep the material moving into the rotor. The blower 42 causes air flow into the end 23 of the air column 21 and then through conduit 26 to the hopper 28 where this air moves the entrained material directly at the inlet to shredder 27. The hopper 28 has a baffle 34 directed into the hopper chamber to cause the air to follow a curved path in its flow to the by-pass conduit 36. The curving air path throws the material out and effectively disengages such material from the air so that the material is released to move through the shredding rotor 32 for second stage reduction.

The usual two stage system employs a first stage cyclone separator and bag collector at some place ahead of the second stage shredder so that the first stage cyclone outlet is then connected to the second stage shredder through a rotary valve. Thereafter, such a system employs a second stage cyclone separator and bag collector. By the system herein disclosed a considerable saving in cost of equipment is made, and less equipment means a saving in space required to set up the present apparatus.

It can now be appreciated that the present apparatus has the unique feature of material density separation downstream from a first shredding step so that the fraction of material remaining can be processed in a second shredding step in a manner that will further reduce the material and prevent clogging and cavitation, and the further unique feature of having a single blower and adjustable dampers arranged to regulate the material density separation effect and establish a negative pressure across the second stage shredding to prevent clogging at this place in the system. The effectiveness of the air separation column 21 may be increased by placement of several baffles 50 along the length of the column.

What is claimed is:

1. In waste material processing apparatus the combination which comprises: a first stage waste material shredding mill; an air column open at the bottom, and having a side inlet above the bottom and a top outlet; means to deliver the shredded waste material from said first stage mill into said side inlet for said air column; a second stage shredding mill having an outlet box at the bottom and an inlet chamber in communication with said air column top outlet; a by-pass conduit interconnecting said inlet chamber and outlet box; and means connected to said second stage mill outlet to establish a flow of air through said column from said open bottom and simultaneously establish a flow of air borne material into said second stage mill and into said second stage outlet through said by-pass.

2. The apparatus of claim 1 wherein said means connected to said second stage outlet includes separator means connected to said outlet and a blower connected to said separator, said blower establishing the separation function of said separator means, the flow of air in said second stage mill and in said air column.

3. The apparatus of claim 2 wherein damper means adjacent said blower and in said by-pass conduit are operable to regulate the flow in said air column and in said by-pass conduit.

4. The apparatus of claim 2 wherein said air column side inlet has a rotary valve to admit shredded waste material and restrict the movement of air between said air column and the atmosphere.

5. The apparatus of claim 2 wherein said separator means has an outlet for second stage shredded material, and a rotary valve is mounted in said outlet to restrict air passage while passing the shredded material.

6. In waste material processing apparatus the combination of a first stage shredding mill, a second stage shredding mill, means interconnecting said mills to deliver a fraction of said first stage shredded material to said second stage shredding mill, a cyclone separator connected to said second stage mill to remove the shredded material from air, a blower connected to said cyclone separator for establishing the flow of the shredded material and air, and means associated with said second stage shredding mill to disengage a portion of the flow of air from the shredded material and direct it in by-pass of said second stage shredding mill.

7. In waste material processing the method which comprises the steps of shredding the waste material in a first stage mill, subjecting the output from the first stage mill to an air separation step in which light weight air borne fractions are separated from heavier weight fractions, processing the air borne fractions in a second stage mill, maintaining the second stage mill under a negative pressure, maintaining air flow from the air separation step through the second stage mill, and extracting the light weight fractions from the air flow beyond the second stage mill.

8. The method set forth in claim 7 wherein the method includes the step of adjusting the flow of air in said air separation step and simultaneously adjusting the negative pressure at said second stage mill to effect air flow through said second stage mill.

* * * * *